United States Patent [19]

Matthews

[11] 4,242,079

[45] Dec. 30, 1980

[54] FUEL IGNITION CONTROL SYSTEM

[75] Inventor: Russell B. Matthews, Goshen, Ind.

[73] Assignee: Johnson Controls, Inc., Milwaukee, Wis.

[21] Appl. No.: 967,261

[22] Filed: Dec. 7, 1978

Related U.S. Application Data

[62] Division of Ser. No. 790,408, Apr. 25, 1977, Pat. No. 4,178,149.

[51] Int. Cl.[3] ..... F23Q 9/14

[52] U.S. Cl. ..... 431/46; 431/51; 431/71; 431/78

[58] Field of Search ..... 431/24, 25, 51, 46, 431/70, 71, 74, 78-80

[56] References Cited

U.S. PATENT DOCUMENTS

| | | | |
|---|---|---|---|
| 3,441,356 | 4/1969 | Walbridge | 431/66 |
| 3,574,496 | 4/1971 | Hewitt | 431/25 X |
| 3,619,097 | 11/1971 | Clay et al. | 431/80 |
| 3,938,937 | 2/1976 | Matthews | 431/78 |
| 3,975,136 | 8/1976 | Baysinger et al. | 431/74 |
| 3,986,813 | 10/1976 | Hewitt | 431/46 |
| 4,035,134 | 7/1977 | Matthews | 431/21 |
| 4,038,019 | 7/1977 | Matthews | 431/78 X |

FOREIGN PATENT DOCUMENTS

| | | | |
|---|---|---|---|
| 1334245 | 10/1973 | United Kingdom | 431/46 |

*Primary Examiner*—Robert S. Ward, Jr.

*Attorney, Agent, or Firm*—Emrich, Root, Lee, Brown & Hill

[57] ABSTRACT

A fuel ignition control system including a control arrangement for operating pilot and main valves of the system the pilot valve being operated to permit a pilot flame to be established, and the main valve being operated by a pilot flame sensing circuit which includes a controlled switching device enabled in response to the charging of a capacitor to a given value to effect the operation of the main valve, the charging of the capacitor being controlled by a further controlled switching device which supplies AC current to the capacitor in the absence of a pilot flame, preventing the capacitor from charging to the given value, and which supplies DC current to the capacitor when a pilot flame is established, permitting the capacitor to charge to the given value. In an embodiment wherein the main valve is energized by a relay controlled by the flame sensing circuit, the control arrangement includes an interlock arrangement which prevents start up of the system under certain failure conditions, such as welded relay contacts. In another embodiment, the system includes an igniter circuit which has a flame responsive enabling circuit which permits the igniter circuit to be enabled and disabled independently of the flame sensing circuit.

12 Claims, 4 Drawing Figures

FUEL IGNITION CONTROL SYSTEM

This is a division of application Ser. No. 790,408, filed Apr. 25, 1977 now U.S. Pat. No. 4,178,149.

BACKGROUND OF THE INVENTION

1. Field of the Invention

This invention relates to fuel ignition control systems of the intermittent pilot type, and more particularly, to control arrangements for use in such systems for providing fail-safe control of fuel valves of the systems.

2. Description of the Prior Art

In known fuel ignition systems of the pilot ignition type, a pilot valve is operated to supply fuel to a pilot outlet for ignition by sparks provided by a suitable igniter to establish a pilot flame. A pilot flame sensing circuit detects the pilot flame and effects the energization of a main valve to supply fuel to a main burner for ignition by the pilot flame.

Typically, the operation of the main valve is controlled by a relay of the flame sensing circuit which is operated by the flame sensing circuit when a pilot flame is established, to close its contacts to connect the main valve to an energizing circuit to permit the main valve to operate. However, for a failure of the flame sensing circuit which permits the relay to be operated in the absence of a flame, the main valve will be connected to the energizing circuit, permitting fuel to emanate from the main burner unburned.

Accordingly, various interlock arrangements have been proposed in the prior art, as exemplified by the U.S. Pat. Nos. 3,449,055 to J. C. Blackett, 3,644,074 to P. J. Cade and 3,705,783 to J. S. Warren, in which the fuel valves of the system can be energized only if the flame relay is initially deenergized. In the patented systems, the energization of the pilot valve is effected in response to the operation of a control relay which can be energized only if the flame relay is deenergized. Thereafter, the main valve is energized in response to the operation of the flame relay when a pilot flame is established, and only if the control relay is energized.

While such interlock circuits guard against the welded contact failure referred to above, it appears that the control (or flame) relay may be energized inadvertantly following a failure of a solid state control device of the electronic circuits, allowing the main valve to operate in in the absence of a pilot flame.

In my U.S. Pat. No. 4,035,134, which was issued on July 12, 1977 and assigned to the assignee of the present application, there is disclosed a proven pilot fuel ignition system including a control arrangement which provides an interlock on start-up to prevent the energization of fuel valves of the system under certain failure conditions, including a component failure in the flame sensing circuit and welded contacts of the flame relay. The control arrangement also permits recycling of the system following a momentary power loss or a flame out condition. Other fuel ignition systems which include interlock arrangements are disclosed in my U.S. Pat. Nos. 4,047,878 issued Sept. 13, 1977; 4,087,230 issued May 2, 1978 and 4,077,762, issued Mar. 7, 1978, all of which are assigned to the assignee of the present application.

While such interlock arrangements afford a degree of protection against an unsafe failure of the flame sensing circuit, it would be more desirable if the fail-safe protection were afforded by the flame sensing circuit itself and such interlock arrangement, if desired, be used as back-up safety control for the system.

In the Great Britain Pat. No. 1,334,245, granted to Honeywell Inc. on Oct. 17, 1973, there is disclosed a direct ignition fuel burner control which affords solid state control of the operation of a fuel valve and an igniter circuit. The fuel valve is controlled directly by an SCR device which is enabled by a timing circuit including a FET device and a capacitor. The FET device is maintained pinched-off during the trial for ignition, or when a flame is established, permitting the capacitor to be charged over a first circuit path including the FET device and a diode, and then discharged over a second circuit path which is connected to the gate of the SCR device, causing the SCR device to maintain the fuel valve in fuel supplying condition. If a flame fails to be established during the trial for ignition, the FET device prevents charging of the capacitor causing the SCR device to deactivate the valve.

While this arrangement eliminates the need for relays and affords a degree of fail safe operation, it appears that under certain failure conditions, the SCR device could be enabled causing the valve to be operated after the trial for ignition interval and in the absence of a flame.

A further consideration is that in most systems, the igniter circuit is disabled by the flame relay. Thus, under certain failure conditions, inadvertant operation of the flame relay may permit fuel to be supplied to the burner apparatus while the igniter is disabled, an undesireable condition.

In the burner control disclosed in the Honeywell Patent, the igniter circuit includes a relaxatior oscillator and a control circuit having an FET device which responds to a flame signal to disable the relaxation oscillator when a flame is established. Although the igniter circuit is disabled by a flame signal, the enabling of the igniter circuit is dependent upon the operation of the SCR device which controls the valve, and thus fault conditions of the valve control circuit may affect the operation of the igniter circuit.

Many known fuel ignition control systems operate from a 24 VAC supply, but require 100VAC for the flame sensing circuit. In such systems, a step-up power transformer is needed to provide isolation of ground and the high voltage for the flame sensing circuit. However, the use of such transformer adds cost to the system.

In the U.S. Pat. No. 3,986,813 to William Hewitt, which issued on Oct. 19, 1976, there is shown an intermittant pilot igniter and valve controller for a gas burner which operates from a 24VAC source without the need for a power step-up transformer. The controller includes a solid state control circuit which controls a relay for operation of a main valve and an igniter. The control circuit includes an FET device which controls the charging and discharging of a capacitor for effecting the operation of the relay in a manner similar to the circuit disclosed in the British patent referenced above. Although the circuit shown by Hewitt eliminates the need for a power transformer, a step-up transformer is required to supply 48 VAC to the flame sensor, and to provide the proper phase relationship between the voltage on the flame sensor probe and the AC supply.

SUMMARY OF THE INVENTION

The present invention has provided a fuel ignition control system including a control arrangement having flame sensing means for controlling the operation of a fuel valve means of the system. The control arrangement does not require an isolation transformer for isolating the flame sensing means from the energizing circuits for the valve means, and the flame sensing means inherently guards against inadvertant operation of the valve means as the result of a component failure of the flame sensing means. Also, in an embodiment wherein the energization of the valve means of the system is controlled by a relay which is enabled by the flame sensing means, the control arrangement includes an interlock arrangement which provides protection against failures, such as welded relay contacts, causing energization of the valve means. The control arrangement may also provide 100% shut off of fuel supply to the system if a flame fails to be established within a trial for ignition interval, or for certain failure conditions.

In another embodiment, the system includes an igniter means which has a flame responsive enabling means which operates independently of the flame sensing means. Thus, any fault that might occur in the flame sensing means will not affect the operation of the igniter means and its relation with the flame.

More specifically, in accordance with a disclosed embodiment, the control arrangement is employed in a fuel ignition control system including a pilot valve operable to supply fuel to a pilot outlet for ignition by sparks provided by an igniter means to establish a pilot flame, and a main valve operable to supply fuel to a main burner for ignition by the pilot flame. The control arrangement includes activate means operable to energize the pilot valve, and flame sensing means which responds to the pilot flame to effect the operation of the main valve. The flame sensing means includes first switching means operable when enabled to energize the main valve, and control means including second switching means which is operable when enabled to effect the enabling of the first switching means, circuit means, including a capacitor, for enabling the second switching means, and enabling means controlled by a sensor means to control the charging of the capacitor to prevent the enabling of the second switching means in the absence of a flame, and to permit enabling of the second switching means when a flame is established.

The flame sensing means is enabled by a cyclical AC signal, and the enabling means includes a controlled switching device, such as a field effect transistor, which is controlled by the sensor means to conduct during positive and negative half cycles of the AC signal in the absence of a flame supplying AC current to the capacitor whereby the average net charge on the capacitor is zero volts during a given cycle of the AC signal, and the second switching means is maintained disabled. The sensor means causes the field effect transistor to conduct only during alternate half cycles of the AC signal when a flame is established supplying DC current to the capacitor so that the capacitor is charged to a value which permits the second switching means to be enabled for operating the first switching means.

The sensor means includes a capacitor, a sensor electrode, which is positioned adjacent to the pilot outlet, and circuit means which connects the capacitor in a charging path with the electrode to permit the capacitor to be charged to provide a control output whenever a flame impinges on the electrode. The field effect transistor responds to the control output to conduct unidirectionally whenever a flame is provided. Also, in the absence of the control output, the field effect transistor is permitted to conduct bidirectionally so that the second switching means is maintained disabled.

As is shown in the following detailed description, the flame sensing means affords fail-safe operation and prevents the operation of the main valve for a component failure of the flame sensing means. Also, such fail-safe operation is afforded without the need for an isolation transformer.

In accordance with a feature of the invention, the activate means may include further switching means which together with the first switching means provides an interlock arrangement which prevents start up of the system for any failure which allows the first switching means to be operated in the absence of a flame or if for any reason normally closed contacts of the first switching means are open at start up. In addition, the activate means may include timeout means which is energized along with the further switching means and operable to define a trial for ignition interval, and to deactivate the system if a flame fails to be established within the trial for ignition interval.

In accordance with a further feature of the invention, the igniter means has an associated enabling means responsive to the sensor means for enabling the igniter means in the absence of the control output, that is in the absence of a flame, and for disabling the igniter means whenever the control output is provided. The enabling means includes a capacitor and a controlled switching device, such as a field effect transistor, which is responsive to the sensor means to control the charging of the capacitor to permit an enabling signal to be extended to the igniter means over the capacitor in the absence of the control output. the control output causes the field effect transistor to supply DC current to the capacitor, for charging the capacitor whereby the igniter means can no longer be enabled over the capacitor, and further spark generation is inhibited.

Other features of the invention will become apparent from the following description which makes reference to the drawings.

DESCRIPTION OF PREFERRED EMBODIMENTS

Figure 1:
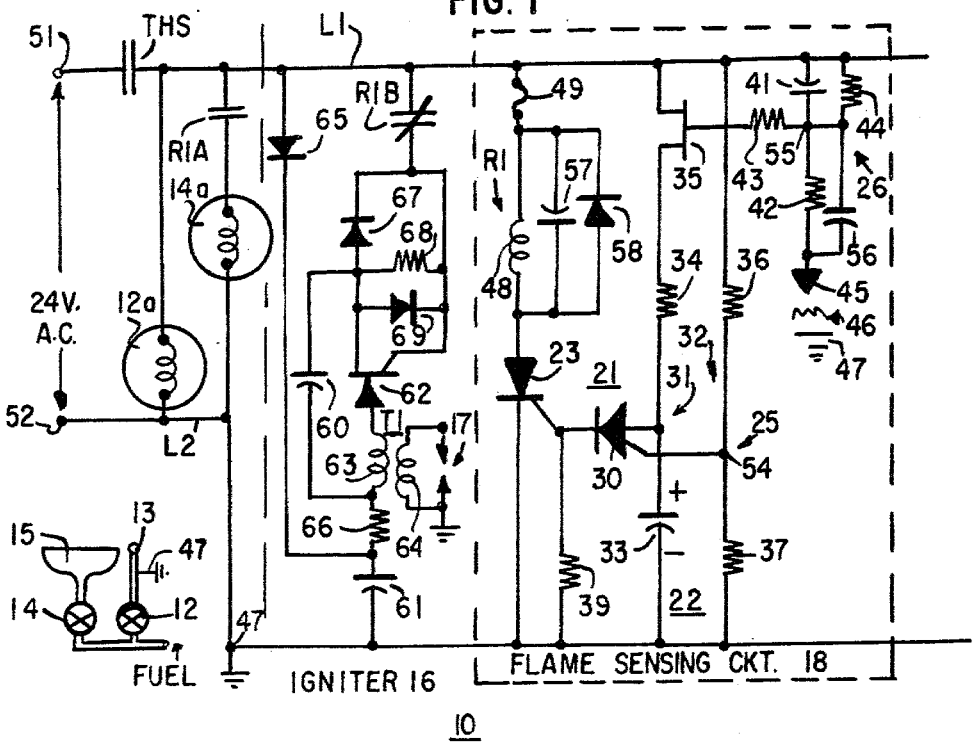
FIG. 1 is a schematic circuit diagram of a fuel ignition control system including a control arrangement provided in accordance with one embodiment of the invention.

Referring to the drawings, FIG. 1 is a schematic circuit diagram of one embodiment for a fuel ignition control system 10 provided by the present invention. The system 10 is described with reference to an application in a heating system of the intermittent pilot type, and includes a pilot valve 12, a main valve 14, an igniter circuit 16, and a flame sensing circuit 18.

The pilot valve 12 is operable when energized to supply fuel to a pilot outlet 13 for ignition by sparks provided by the igniter circuit 16. The pilot valve 12 is energized in response to the closing of contacts THS, which may be thermostatically controlled, and which are operable when closed to extend an AC energizing signal to power conductors L1 and L2 of the system 10. The igniter circuit 16 is also energized when power is applied to conductors L1 and L2 to generate ignition sparks between ignition electrodes 17, which are located adjacent to the pilot outlet 13.

When the pilot fuel is ignited, the flame sensing circuit 18 responds to the pilot flame to effect the operation of the main valve 14. The flame sensing circuit 18 includes an actuator circuit 21 and an enabling circuit 22. The actuator circuit 21 includes a switching device, embodied as a relay R1, which effects the operation of the main valve 14 over contacts R1A, and effects the deenergization of the igniter circuit 16 over contacts R1B. The actuating circuit 21 also includes a controlled switching device, such as a silicon controlled rectifier 23, which is operable under the control of the enabling circuit 22 to effect the operation of the relay R1.

The enabling circuit 22 includes a control section 25 and a flame sensing network 26. The control section 25 includes a controlled switching device, embodied as a programmable unijunction transistor 30 which is operable under the control of an anode control network 31 and a gate control network 32 to enable the SCR device 23 whenever a pilot flame is established.

The anode control network 31, which includes a capacitor 33, a resistor 34, and a controlled switching device embodied as a field effect transistor 35, determines the potential at the anode of the PUT device 30. The gate control network 32, which includes resistors 36 and 37, establishes a reference potential at the gate of the PUT device 30. The PUT device 30 is enabled whenever the anode potential exceeds the gate potential by +0.6 volts. When a flame is established, the FET device 35 is "pinched off", and capacitor 33 is permitted to charge of a value which causes the anode potential to exceed the gate potential by +0.6 volts, thereby enabling the PUT device 30. In the absence of a flame, the conduction of the FET device 35 prevents the capacitor 33 from charging to such value, and the PUT device 30 is maintained cutoff.

The conductivity of the FET device 35, which controls the charging of capacitor 33, is in turn controlled by the flame sensing network 26 which establishes the gate potential for the FET device 35. The flame sensing network 26 includes a capacitor 41, resistors 42–44 and a flame sensing electrode 45. Resistor 42 and the flame sensing electrode 45 provide a charging path which permits the capacitor 41 to be charged by flame rectified current whenever a pilot flame is established. The sensing electrode 45 is located in the proximity of the pilot outlet 13 in a spaced relationship therewith defining a gap 46 therebetween. The pilot outlet 13 is connected to a ground reference point 47 for the system 10.

In the absence of a flame, the capacitor 41 is prevented from charging so that the FET device 35 conducts during both positive and negative half cycles of the AC signal. Whenever a flame bridges the gap 46 between the sensing electrode 45 and the ground reference point 47, the capacitor 41 is charged by flame current conducted over the flame and the sensing electrode 45 and through resistor 42 to the capacitor 41, causing the FET device 35 to become "pinched off", so that the FET device 35 conducts only during the positive half cycles of the AC signal. This permits capacitor 33 to be charged to a potential which enables the PUT device 30 to conduct.

When the PUT device 30 conducts, capacitor 33 discharges over the PUT device 30, enabling the SCR device 23 to operate the relay R1. When relay R1 operates, contacts R1A are closed energizing the main valve 14 which opens to supply fuel to a main burner 15 for ignition by the pilot flame. Also, contacts R1B are opened to disable the igniter circuit 16. Relay R1 and the fuel valves 12 and 14 remain energized until contacts THS open when the heating demand has been met, at which time power is disconnected from conductors L1 and L2 deactivating the system 10.

As will be shown in more detail hereinafter, the flame sensing circuit 18 provided by the present invention, prevents operation of the main valve 14, or causes deactivation of the valve 14 following a successful ignition cycle, for a malfunction of the flame sensing circuit 18, including open or short circuit conditions for the switching devices or for the passive elements of the circuit 18. Also, in accordance with the present invention, the flame sensing circuit 18 is energized directly over the power conductors L1 and L2 over which the fuel valves 12 and 14 and the ignition circuit 16 are energized, thereby eliminating the need for an isolation transformer.

DETAILED DESCRIPTION

Considering the fuel ignition control system 10 in more detail, the system 10 has input terminals 51 and 52 connectable to a 24 VAC source. Terminal 51 is connected over normally open thermostatically controlled contacts THS to conductor L1, and terminal 52 is connected directly to conductor L2, which is connected to system ground.

The pilot valve 12 has an operate solenoid **12*a* connected between conductors L1 and L2 to be energized whenever contacts THS close connecting power to conductors L1 and L2. The main valve 14 has an operate solenoid 14*a*** connected between conductors L1 and L2 in series with normally open contacts R1A of relay R1 to be energized when relay R1 operates.

The igniter circuit 16 is similar to the igniter circuit disclosed in my copending U.S. Pat. No. 4,077,762, and accordingly, the igniter circuit 16 will not be described in detail in the present application. Briefly, the igniter circuit 16 is of the capacitor discharge type and includes a capacitor 60 which is charged and then discharged over the primary winding 63 of an ignition transformer T1, during alternate half cycles of the AC line signal to provide sparks over the ignition electrodes 17 which are connected to the secondary winding 64 of the ignition transformer T1.

The igniter circuit 16 is energized over normally closed contacts R1B of relay R1 whenever power is applied to conductors L1 and L2 and relay R1 is unoperated. The igniter circuit 16 includes a voltage doubler network including the capacitor 60 and a further capacitor 61 which enables the capacitor 60 to be charged to approximately twice the line voltage. Capacitor 61 is charged during positive half cycles of the AC line voltage, that is when conductor L1 is positive relative to conductor L2, and capacitor 60 is charged over capacitor 61 during the next negative half cycle of the AC line signal, with the charge on capacitor 61 being transferred to capacitor 60. During the next positive half cycle, when the AC signal starts to swing off peak, capacitor 60 begins to discharge over a path which extends from one side of the capacitor 60, through resistor 66 and capacitor 61 to conductor L2, through the secondary winding of an input transformer (not shown), contacts THS and R1B, and the gate to cathode of an SCR device 62 to the other side of the capacitor 60. The SCR device 62 is thus enabled, providing a discharge path for the capacitor 60 over the primary winding 63 of the ignition transformer T1, with the discharge current inducing a voltage pulse in the secondary winding 64 which is applied to the ignition electrodes 17, causing a spark to be generated. The igniter circuit 16 continues to operate in this manner until the fuel is ignited at which time relay R1 is operated, opening contacts R1B deenergizing the igniter circuit 16.

Referring to the flame sensing circuit 18, resistors 36 and 37 of the gate control network 32 are connected in series between conductors L1 and L2. The junction of the resistors 36 and 37 at point 54 is connected to the gate of the PUT device 30, enabling an AC reference voltage to be established at the gate of the PUT device 30 whenever power is applied to conductors L1 and L2.

Capacitor 33 and resistor 34 of the anode control network 31 are connected in series with the source to drain circuit of the FET device 35 between conductors L1 and L2. The FET device 35 may, for example, be an N-channel, depletion mode field effect transistor, such as the Type 2N5458.

The FET device 35, which controls the charging of capacitor 33, conducts whenever its gate potential is positive with respect to its source potential. In the absence of a charge on capacitor 41, the FET device 35 conducts current in both directions, that is during both positive and negative half cycles of the AC line signal. This results in an average net charge of zero volts on the capacitor 33, and thus, the anode to gate potential for the PUT device cannot exceed +0.6 volts, and the PUT device 30 remains cutoff. When the gate potential of the FET device 35 is negative with respect to the source potential for the device 35, the FET device 35 is "pinched off". In the present application, the FET device 35 is "pinched off" during negative half cycles whenever capacitor 41 is charged. Thus, the FET device 35 acts as a diode, and permits current flow only from conductor L1 to conductor L2 during positive half cycles, permitting capacitor 33 to become charged. When capacitor 33 is charged to a value which raises the potential at the anode of the PUT device 30 to a value that is +0.6 volts greater than the reference voltage provided at the gate of the PUT device by resistors 36 and 37, the PUT device 30 is enabled.

As indicated above, the gate potential for the FET device 35 is established by the flame sensing network 22 including capacitor 41 and resistors 42–44. Capacitor 41 is connected in a series charging path which extends from conductor L1 over the capacitor 41 and resistor 42 to the sensing electrode 45, and the gap 46 to ground. The junction of resistor 42 and capacitor 41 at point 55 is connected over resistor 43 to the gate of the FET device 35. The resistor 44 is connected in parallel with capacitor 41 between conductor L1 and point 55, providing a bleeder path for the capacitor 41. A capacitor 56 is connected between point 55 and electrode 45 to reduce the spark interference which would increase the minimum sensing voltage.

In the absence of a flame, the charging circuit is virtually an open circuit, preventing charging of capacitor 41. However, whenever a flame bridges the gap 46 between the sensing electrode 45 and the ground reference point 47, current flows during positive half cycles of the AC line signal from conductor L1, through capacitor 41 and resistor 42, to the sensing electrode 45, through the flame to ground, providing a flame signal for charging the capacitor 41 with the polarity indicated in FIG. 1. Accordingly, the junction of capacitor 41 and resistor 42 at point 55 is negative with respect to conductor L1, such potential being extended over resistor 43 to the gate of the FET device 35. Thus, whenever capacitor 41 is charged, then during negative half cycles of the AC line signal, capacitor 41 maintains the potential at the gate of the FET device 35 negative with respect to the potential at the source of the device 35, and the device 35 is "pinched-off", blocking reverse current flow through capacitor 33 when a flame signal is present. During the positive half cycles, however, the capacitor 33 is permitted to charge, accumulating a net charge until the PUT device 30 is enabled.

Whenever a flame is established, the charging of capacitor 33 causes the potential at the anode of the PUT device 30 to increase, and when the potential at the anode exceeds the gate potential by +0.6 volts, the PUT device 30 is enabled, permitting the capacitor 33 to discharge over the anode to cathode circuit thereof.

The cathode of the PUT device 30 is connected to the gate of the SCR device 23, and over a resistor 39 to conductor L2. The SCR device 23, which controls the energization of the relay R1 has its anode connected to one side of the operate winding 48 of the relay R1, the other side of which is connected over a fuse 49 to conductor L1. The cathode of the SCR device 23 is connected to conductor L2 so that when the SCR device 23 is enabled, the operate winding 48 of the relay R1 is effectively connected between conductors L1 and L2, permitting the relay R1 to operate.

The PUT device 30, which controls the enabling of the SCR device 23, is pulsed into operation, providing an enabling pulse for the SCR device 23 for a portion of each cycle of the AC signal. During the time that the SCR device 23 is non-conducting, in response to the current reversal at the start of the negative half cycle of the AC signal, the relay R1 is maintained energized by capacitor 57 and free-wheeling diode 58 which are connected in parallel with the operate winding 48 of the relay R1.

OPERATION

When contacts THS close in response to a request for heat, current flows through contacts THS to conductor L1 and over the pivot valve solenoid **12*a* to conductor L2, causing the pilot valve 12 to operate to supply fuel to the pilot outlet 13 for ignition. Current also flows from conductor L1 over contacts R1B to energize the igniter circuit 16 generates sparks at electrodes 17 for igniting the pilot fuel. When the pilot fuel is ignited, the flame bridges the gap 46 between the electrode 45 and ground point 47, permitting current to flow from conductor L1 through capacitor 41 and resistor 44 and through resistor 42 to electrode 45, through the flame and to ground. The flame both conducts and rectifies the current, permitting a DC voltage to be established across the capacitor 41, charging the capacitor 41. It should be noted that the rectification property of the flame is necessary to build the charge on capacitor 41. A resistance substituted for the flame will place AC on capacitor 41, resulting in no charge buildup. In order for the sensing circuit 18 to recognize the difference between a flame and a leakage resistance, the value of capacitor 41 is chosen to be large enough so that it cannot charge during one cycle of the AC line signal applied between conductors L1 and L2. The charge time of capacitor 41** is longer than one cycle of the AC signal so that the DC signal resulting from a leaky electrode condition is zero.

When conductor L1 is positive with respect to conductor L2, current flows through the FET device 35 and over resistor 34 and capacitor 33 to conductor L2, charging the capacitor 33. Also, when capacitor 41 is charged, then when conductor L2 is positive with respect to conductor L1, the FET device 35 is "pinched off" because the gate potential is negative with respect to the source potential.

Thus, after a flame is established, then during positive half cycles of the AC line signal, current flows through the FET device 35, the resistor 34 and the capacitor 33, charging the capacitor 33 to the polarity indicated in FIG. 1. The voltage on the capacitor 33 is applied to the anode electrode of the PUT device 30. The values for the resistor 34 and the capacitor 33 are chosen so that the time required for the charge on capacitor 33 to exceed the gate voltage established by the voltage dividing resistors 36 and 37 is greater than one cycle of the AC line signal, and may for example be in the order of four cycles. Thus, when the voltage on the capacitor 33 raises the anode potential for the PUT device 30 to a value that is +0.6 volts greater than the reference voltage established at the gate of the PUT device 30 by resistors 36 and 37, the PUT device 30 conducts and discharges the capacitor 33 into the gate of the SCR device 23 and resistor 39 during a positive half cycle.

Accordingly, the SCR device 23 conducts, energizing the operate winding 48 of relay R1 which then operates to close contacts R1A and to open contacts R1B. When contacts R1A close, the operate solenoid 14*a* of the main valve 14 is energized, and the main valve 14 operates to supply fuel to the main burner 15 for ignition by the pilot flame. When contacts R1B open, the igniter circuit 16 is deenergized, terminating further spark generation.

For a flame out condition, or before a flame is established at start-up, the FET device 35 is a low resistance element in the anode control network 31, and conducts during both positive and negative half cycles of the AC line signal. Accordingly, since AC current is conducted in both directions, over the anode control network 31, this results in an average net charge of zero volts on the capacitor 33. Therefore, the PUT device 30 is held cutoff and the relay R1 is maintained deenergized.

When the heating demand has been met, contacts THS open, deenergizing the fuel valves 12 and 14, and deactivating the flame sensing circuit 18 causing relay R1 to drop out and the system 10 is prepared for the next ignition cycle.

Safety Aspects

The flame sensing circuit 18 of the present invention inherently prevents the operation of the relay R1 for component failures of the circuit 18. For example, an open circuit condition for the FET device 35 prevents capacitor 33 from charging, and a short circuit condition for the device 35 causes AC current to be supplied to the capacitor 33 with the end result in either case that the PUT device 30 is not enabled.

For an open condition for the PUT device 30, the flame sensing network 26 and the anode and gate control networks 31 and 32 are ineffective to effect operation of the relay R1. Also, if the PUT device 30 becomes shorted or for an open or short circuit condition for the gate of the PUT device 30, then capacitor 33 is discharged over the device 30 before the capacitor 33 has received sufficient charge to trigger the SCR into conduction.

For an open or short circuit condition for the capacitor 41, the FET device 35 is prevented from being "pinched off" and the capacitor 33 cannot charge to enable the PUT device 30.

If capacitor 33 becomes open, the PUT device 30 will conduct early in the AC cycle, and the value of resistor 34 is chosen to be large enough so that the voltage on the gate of the SCR device 23 is below the firing point for the device 23. If capacitor 33 becomes shorted, then there is no discharge current for enabling the SCR device 23.

Also, if resistor 34 or resistor 37 become shorted, or if resistor 36 becomes open circuited, then the PUT device 30 is fired before the capacitor 33 has accumulated enough energy to enable the SCR device 23. Further, if resistor 34 or resitor 37 become open, of if resistor 36 becomes shorted, then the PUT device 30 cannot fire. The PUT device 30 is also maintained non-conducting if resistor 39 becomes open or short circuited.

If the SCR device 23 becomes short circuited, then when power is applied to conductors L1 and L2, the fuse 49 will blow, interrupting the energizing path for the relay R1.

Thus, the flame sensing circuit 18 is virtually fail-safe, and the energizing of the relay R1 is prevented for component failures of the circuit 18.

Second Embodiment

Figure 2:
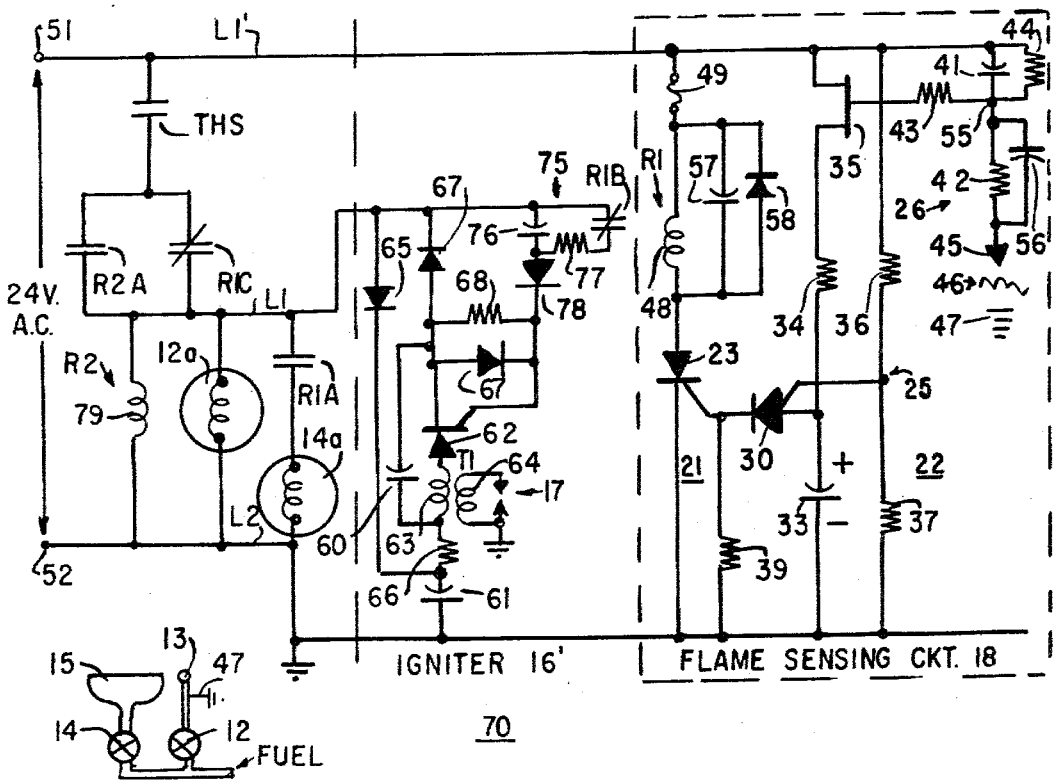
FIG. 2 is a schematic circuit diagram of a fuel ignition control system including a control arrangement provided in accordance with a second embodiment of the invention.

Referring to FIG. 2, there is shown a schematic circuit diagram of a second embodiment for a fuel ignition control system 70 provided by the present invention. The system 70 employs the pilot valve 12, the main valve 14, and the flame sensing circuit 18 of the system 10 shown in FIG. 1, and accordingly, like elements have been given the same reference numerals. The system 70 also employs an igniter circuit 16' of the capacitor discharge type which is generally similar to the igniter 16 shown in FIG. 1, but which includes a timing network 75 which permits the igniter circuit 16' to provide a lingering spark for a predetermined time, such as ten seconds, after the relay R1 operates to disable the igniter circuit 16'. The manner in which the igniter circuit 16' is operable to provide a lingering spark is disclosed in detail in the referenced application, and will not be described in detail herein.

In addition, the system 70 includes a checking or interlock relay R2, which together with relay R1 forms an interlock circuit which prevents start up if for any reason relay R1 is operated at start up, as may occur for example in the event of a malfunction of the flame sensing circuit 18 which permits relay R1 to be operated in the absence of a flame, or if contacts R1A of relay R1, which control the operation of the main valve 14, become welded together.

Considering the system 70 in more detail, the system 70 has input terminals 51 and 52 connectable to a 24 VAC source The operating solenoid 12*a* of the pilot valve 12 has one end connected to conductor L1 which is connected over normally closed contacts R1C of the relay R1 and normally open contacts THS to terminal 51, and its other end connected to conductor L2, which is connected to ground and to terminal 52. Thus, the pilot valve 12 is energized whenever contacts THS close and contacts R1C are closed, and operates to supply fuel to the pilot outlet 13 for ignition to provide a pilot flame.

The main valve 14 has its operate solenoid 14*a* connected between conductors L1 and L2 in series with the normally open contacts R1A of relay R1. The main valve 14 is energized when relay R1 operates to close contacts R1A, and operates to supply fuel to the main burner for ignition by the pilot flame.

The igniter circuit 16' is connected between conductors L1 and L2 for energization thereover whenever contacts THS close and contacts R1A of relay R1 are closed. As is fully described in the referenced application, prior to the operation of relay R1, the igniter circuit 16' receives energizing current from conductor L1 over normally closed contacts R1B of relay R1 and resistor 77. When relay R1 operates and contacts R1B open, the igniter circuit 16' receives energizing current from conductor L1 over a timing capacitor 76 of the timing network 75, which is normally shunted by contacts R1B and resistor 77. Thus, when contacts R1B are open, the igniter circuit 16' continues to be energized over capacitor 76 for a given time, in the order of ten seconds, defined by the charging time of the capacitor 76. When the capacitor 76 is charged, the igniter circuit 16' is inhibited and spark generation is terminated.

The interlock relay R2 has an operate winding 79 connected between conductors L1 and L2 to be energized whenever contacts THS close and contacts R1C are closed. Relay R2 has normally open contacts R2A which are connected in shunt with contacts R1C to provide an energizing path for the fuel valves 12 and 14 and the igniter circuit 16' after relay R1 operates to open contacts R.I.C.

The flame sensing circuit 18 is connected between a conductor L1' and conductor L2, conductor L1' being connected directly to terminal 51 of the system 70 so that the flame sensing circuit 18 is continuously energized when power is applied to terminals 51 and 52.

Operation

Briefly, in operation, when contacts THS close in response to a request for heat, the pilot valve 12 is energized, if contacts R1C of relay R1 are closed at the time contacts THS close. Accordingly, the pilot valve 12 operates to supply fuel to the pilot outlet 13 for ignition by sparks provided by the igniter circuit 16' which is also energized at this time.

Relay R2 also operates, closing contacts R2A to provide a shunt path around contacts R.I.C. to permit the pilot valve 12 and the igniter circuit 16' to remain energized after relay R1 operates.

When a pilot flame is established and impinges on the electrode 45 of the flame sensing network 22, the flame sensing circuit 18 is operable in the manner described above, with the FET device 35 being controlled to permit capacitor 33 to charge to a value which effects the enabling of the PUT device 30. The PUT device 30 causes the capacitor 33 to discharge into the gate of the SCR device 23, causing relay R1 to operate.

When relay R1 operates, contacts R1A close to effect the energization of the main valve 14 which operates to supply fuel to the main burner 15 for ignition by the pilot flame. Also, contacts R1B are opened, disabling the igniter circuit 16' which is maintained operable by the timing capacitor 76 to provide a lingering spark for approximately ten seconds after relay R1 operates. The lingering spark is provided to afford an additional ignition attempt in the event of a momentary power interruption which follows a malfunction of the flame sensing circuit 18 which permits relay R1 to operate prematurely. The lingering spark will ignite the fuel when power is restored. At the end of the heating cycle, contacts THS will open to deactivate the system 70, and the system 70 will not restart on the next call for heat because relay R1 will remain operated with contacts R1C being maintained open, preventing energization of the fuel valves 12 and 14.

When relay R1 operates, contacts R1C are also opened, interrupting the initial energizing path for the pilot valve 12 and the igniter circuit 16', such elements being maintained energized over the energizing path afforded by contacts R2A of relay R2. The fuel supply valves 12 and 14 thus remain energized over contacts R2A until contacts THS open at the end of the heating cycle.

In the event of a failure of the flame sensing circuit 18 which permits the relay R1 to be operated in the absence of a flame, contacts R1C of the relay R1 are maintained open, so that when contacts THS close on the next call for heat, the system 70 cannot restart. Similarly, in the event that contacts R1A of the relay R1, which control the energization of the main valve 14 become welded together, then contacts R1C, which employ a common armature of the relay R1 cannot reclose and the system 70 is locked out when contacts THS open at the end of the heating cycle.

Third Embodiment

Figure 3:
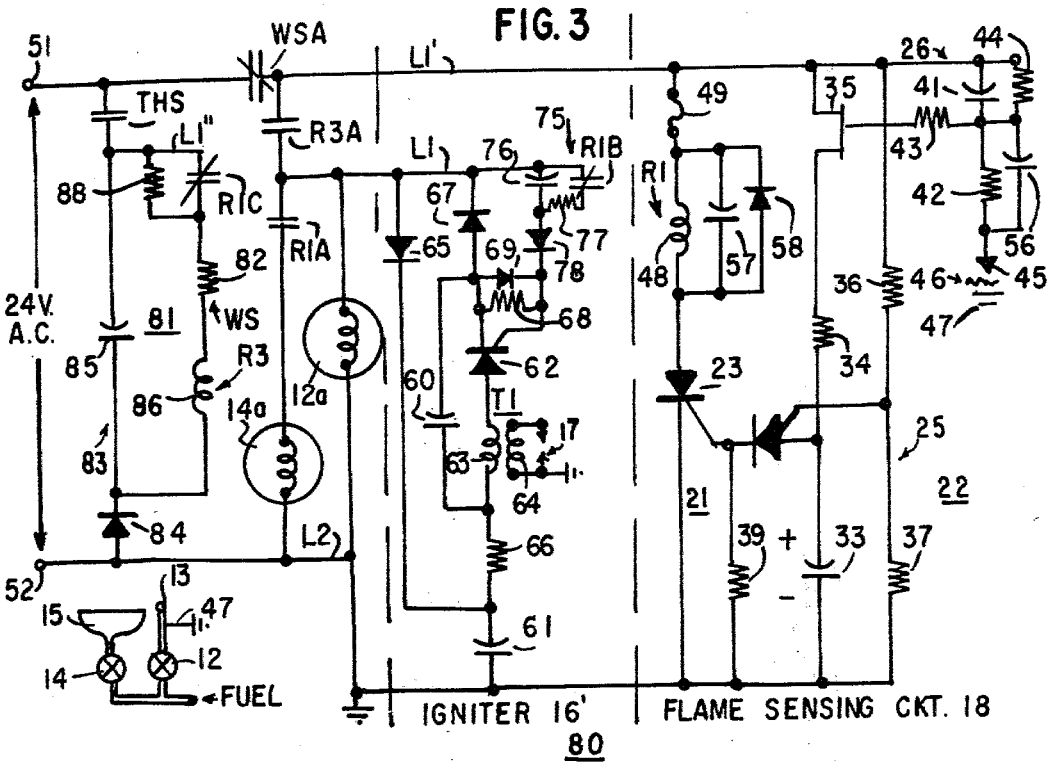
FIG. 3 is a schematic circuit diagram of a fuel control system including a control arrangement provided in accordance with a third embodiment of the invention; and, FIG. 4 is a schematic circuit diagram of a fuel ignition control system including a control arrangement provided in accordance with a fourth embodiment of the invention.

Referring to FIG. 3, there is shown a schematic circuit diagram for a third embodiment of a fuel ignition control system 80 provided by the present invention. The system 80 employs the pilot valve 12, the main valve 14, the igniter circuit 16', and the flame sensing circuit 18 of the system shown in FIG. 2 and thus, like elements have been given the same reference numerals in the drawing.

In addition, the system 80 includes an activate circuit 81 including a checking or interlock relay R3 and a timeout device, embodied as a warp switch WS which provide interlock protection and total deactivation of the system 80 under certain failure conditions of if a flame fails to be established within a trial for ignition interval defined by the heating time of a heater element 82 of the warp switch WS. The activate circuit 81 further includes an enabling network 83, including a diode 84 and a capacitor 85, which respond to the closing of thermostatically controlled contacts THS to energize the warp switch heater element 82 and the operate winding 86 of the relay R3, for operating the relay.

Relay R3 is operable when energized to close contacts R3A to effect the operation of the pilot valve 12 and the igniter circuit 16'. The closing of contacts R3A also permits the main valve to be energized under the control of relay R1 of the flame sensing circuit 18 when a pilot flame is established.

Relay R3 is energized in response to the closing of contacts THS which permits capacitor to be charged and then discharged over the operating winding 86 of relay R3. However, if for any reason contacts R1C of relay R1 are open at start up, relay R3 cannot operate and the system 80 is locked out.

If a flame fails to be established during the trial for ignition interval defined by the warp switch WS, the warp switch WS operates to open contacts WSA to deactivate the system 80, providing total shut off of fuel supply to the burner apparatus and deenergizing the flame sensing circuit 18.

Considering the system 80 in more detail, diode 84 and capacitor 85 of the enabling network 83 are connected in series with contacts THS between conductors L2 and L1" which are connected to respective input terminals 52 and 51 of the system 80. Terminals 51 and 52 are in turn connectable to a 24 VAC source. The heater element 82 of the warp switch WS and the operate winding 86 of relay R3 are connected in a series circuit path with the normally closed contacts R1C of relay R1 in shunt with capacitor 85. A resistor 88 is connected in shunt with contacts R1C of relay R1 to provide a holding path for relay R3 when relay R1 operates to open contacts R1C. The value of resistor 88 is selected to permit relay R3 to remain energized while decreasing the current in the warp switch heater 82 to approximately one-tenth the level provided when contacts R1C are closed, to prevent the warp switch WS from operating. Also, relay R3 cannot be energized over the resistor 88.

The pilot valve solenoid 12*a* and the igniter circuit 16' are connected between conductors L1 and L2 to be energized whenever power is applied to conductors L1 and L2. Conductor L1 is connected over normally open contacts R3A of relay R3 and the normally closed contacts WSA of the warp switch WS to terminal 51 so that the pilot valve 12 and the igniter circuit 16' are energized when relay R3 operates and contacts WSA are closed. The main valve solenoid 14*a* is connected in series with the normally open contacts R1A of relay R1 between conductors L1 and L2.

The flame sensing circuit 18 is energized over conductors L1' and L2, conductor L1' being connected to terminal 51 over warp switch contacts WSA so that the flame sensing circuit 18 is continuously energized when power is applied to terminals 51 and 52 and contacts WSA are closed.

Operation

In operation, when contacts THS close, capacitor 85 is charged during the first negative half cycle of the AC line signal, when conductor L2 is positive with respect to conductor L2". During the next positive half cycle of the AC line signal, capacitor 85 discharges over the circuit path including contacts R1C, the warp switch heater element 82 and the operate winding 86 of relay R3, causing the relay R3 to operate. Also, heating current is supplied to the warp switch heater element 82 which begins to heat. The capacitor 85 thereafter continues to be charged and discharged during each cycle of the AC line signal while contacts THS are closed, maintaining the relay R3 operated and providing heating current for the warp switch heater 82.

When relay R3 operates, contacts R3A close energizing the pilot valve 12 and the igniter circuit 16'. When ignition occurs, and the flame contacts the flame sensing electrode 45, the flame sensing circuit 18 operates as described above to cause relay R1 to operate. As indicated above, if a flame fails to be established within the heating time of the warp switch WS, typically fifteen seconds, the warp switch operates, opening contacts WSA to lock out the system 80. It should be noted that in the lock out condition, any subsequent failure cannot cause the fuel valves to be energized.

When relay R1 operates following ignition of the pilot fuel, contacts R1A close to energize the main valve 14, and contacts R1B open to disable the igniter circuit 16'. Also, contacts R1C open, inserting register 88 in series with the warp switch heater element 82 and the operate winding 86 of relay R3, maintaining the relay R3 energized and decreasing the current in the warp switch heater below the heating level so that the warp switch remains cool, and lockout of the system 80 by the warp switch is prevented. The system 80 remains activated until contacts THS open when the heating demand has been met.

In the event of a flame out, the flame sensing circuit 18 operates as described above to deenergize the relay R1, causing contacts R1A to open deenergizing the main valve 14. Also, contacts R1B close energizing the igniter circuit 16', and contacts R1C close energizing the warp switch heater element 82 at the heating level, and a new trial for ignition cycle is initiated.

As indicated above, the flame sensing circuit 18 affords fail safe operation which prevents operation of the relay R1 in the event of a component failure in the flame sensing circuit 18. However, if for any reason relay R1 is operated in the absence of a flame, then when the system 80 is deactivated by the opening of contacts THS, contacts R1C of relay R1 will remain open. Likewise if contacts R1A, which control the operation of the main valve 14, become welded together following a heating cycle, then contacts R1C, which employ a common armature of the relay R1, cannot reclose when the relay R1 is deenergized. In any case, when contacts R1C are open at start up, relay R3 cannot operate and the system 80 is maintained locked out.

Fourth Embodiment

Figure 4:
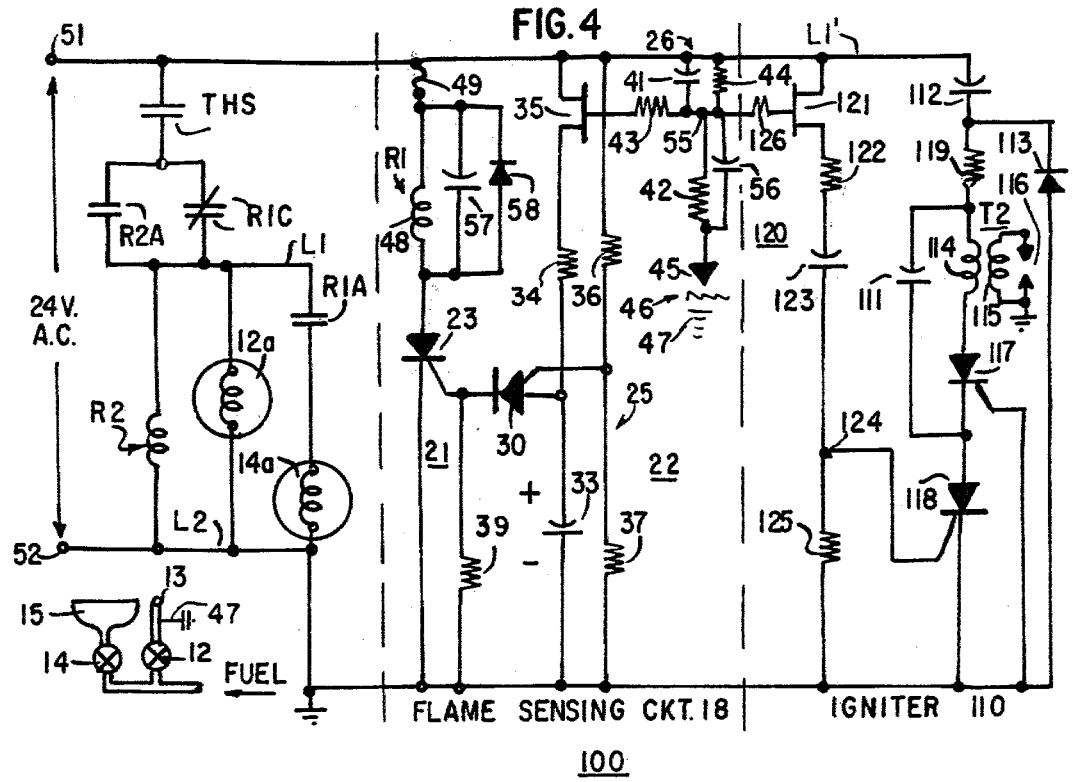

In FIG. 4, there is shown a schematic circuit diagram for a fourth embodiment of a fuel ignition control system 100 provided by the present invention. The system 100 employs the pilot valve, the main valve, the flame sensing circuit, and the checking or interlock relay R2 of the system 70 shown in FIG. 2, and accordingly, the same or similar elements have been given the same reference numerals.

In addition, the system 100 includes an igniter circuit 100 which is responsive to the flame and independent of the flame sensing circuit 18. Therefore, any fault that might occur in the flame sensing circuit 18 will not affect the operation of the igniter circuit 110 and its relation with the flame.

The connections of the fuel valves 12 and 14, the interlock relay R2, and the flame sensing circuit 18 have been set forth in detail in the foregoing description with respect to the systems 10 and 70 shown in FIGS. 1 and 2.

Referring to the igniter circuit 110, the igniter circuit is of the capacitor discharge type and includes a capacitor 111 which is charged and then discharged over the primary winding 114 of an ignition transformer T2 during alternate half cycles of the AC line signal to provide sparks over ignition electrodes 116 which are connected to the secondary winding 115 of the transformer T2.

The igniter circuit 110 includes a voltage doubler network including capacitor 111 and a further capacitor 112 which enables the capacitor 111 to be charged to approximately twice the AC line voltage. The igniter circuit 110 also includes an enabling network 120, including a controlled switching device, embodied as a field effect transistor 121 and a timing capacitor 123, which is responsive to the flame to permit the igniter circuit 110 to operate to generate sparks in the absence of a flame and which causes the igniter circuit 110 to be disabled whenever a flame is established.

Considering the igniter circuit 110 in more detail, capacitor 112 is connected in a unidirectional charging path with a diode 113 between conductor L2 and conductor L1 to be charged during negative half cycles of the AC line signal when power is applied to conductors L1′ and L2. Capacitor 111 is connected in a series charging path which extends from conductor L1′ over capacitor 112, a resistor 119, the capacitor 111 and a normally disabled silicon controlled rectifier 118 to conductor L2, permitting capacitor 111 to be charged during positive half cycles of the AC line signal whenever the SCR device 118 is conducting. As will be shown hereinbelow, the SCR device 118 is enabled by the enabling network 120 during positive half cycles of the AC line signal whenever a flame is not impinging on the flame sensing electrode 45.

The primary winding 114 of the transformer T2 is connected in series with a further SCR device 117 in parallel with capacitor 111 to provide a discharge path for capacitor 111 over the primary winding 114 whenever the SCR device 117 is conducting. The discharge current induces a voltage pulse in the secondary winding 115 of the transformer T2 which is applied to the ignition electrodes 116, which are connected to the secondary winding 115, causing a spark to appear in the gap between the electrodes 116. The electrodes 116 are positioned adjacent to the pilot outlet 13 to permit the sparks to ignite pilot fuel emanating therefrom.

Referring to the enabling network 120, timing capacitor 123 is connected in a series charging path with the FET device 121, the path extending from conductor L1′ over the drain-source circuit of the device 121, and a resistor 122 to one side of the capacitor 123, and from the other side of the capacitor 123 at point 124 over a resistor 125 to the conductor L2. The gate of the FET device 121 is connected over a resistor 126 to point 55 at the junction of capacitor 41 and resistor 42 of the flame sensing network 22.

The enabling network 120 operates in a manner similar to the flame sensing network 26 and the anode control network 31 for the PUT device 30, as described above. That is, in the absence of a flame, when capacitor 41 is discharged, the FET device 121 conducts during both positive and negative half cycles of the AC line signal so that the net charge on capacitor 123 is zero volts. Also, during positive half cycles, the AC current flow through the FET device 121, resistor 122, capacitor 123, and resistor 125 causes the SCR device 118 to conduct, energizing the igniter circuit 110 and permitting capacitor 111 to charge, and then discharge over the ignition transformer during the next negative half cycle.

When a flame impinges on the flame sensing electrode 45, capacitor 41 is charged and the FET device 121 is "pinched off" during negative half cycles of the AC line signal so that capacitor 123 becomes charged and cuts off the current flow to the gate of the SCR device 118, inhibiting the igniter circuit 110 thereby terminating spark generation.

Operation

Considering the operation of the system 100, when a 24 VAC energizing signal is applied to the input terminals 51 and 52 of the system 100, the flame sensing circuit 18 and the igniter circuit 110 are energized. When contacts THS close in response to a request for heat, the pilot valve solenoid **12*a* is energized over normally closed contacts R1C of relay R1 and the pilot valve 12 operates to supply fuel to the pilot outlet 13** for ignition. Relay R2 also operates to close contacts R2A, providing a shunt path around contacts R1C of relay R1.

Referring to the igniter circuit 110, prior to ignition of the pilot fuel, capacitor 41 of the flame sensing network 26 is discharged, and the FET device 121 conducts AC current during both positive and negative half cycles. Thus, the SCR device 118 is enabled during each positive half cycle of the AC signal.

During a given negative half cycle, capacitor 112 is charged over diode 113 and during the next positive half cycle, with the SCR device 118 conducting, capacitor 111 is charged over capacitor 112 with the charge on capacitor 112 being transferred to capacitor 111. When conductor L2 becomes positive with respect to conductor L1′, the SCR device 118 is cutoff. Also, the voltage on the capacitor 111 is greater than the line voltage and capacitor 111 begins to discharge permitting current to flow from one side of the capacitor 111 over resistor 119 and capacitor 112 to conductor L1′, through the power source connected to terminals 51 and 52 and back to conductor L2, and over the gate-cathode circuit of the SCR device 117 to the other side of the capacitor 111. The current flow over the gate circuit of the SCR device 117 causes the SCR device 117 to conduct, permitting capacitor 111 to discharge over the primary winding 114 of the ignition transformer T2. Accordingly, a voltage pulse is induced in the secondary winding 115 and applied to the electrodes 116, causing a spark to be generated. The above operation continues until the pilot fuel is ignited.

When ignition occurs, the flame impinges on the flame sensing electrode 45, permitting capacitor 41 to become charged and the flame sensing circuit 18 operates as described above to cause relay R1 to operate to energize the main valve 14 and to interrupt the energizing path over contacts R1C so that the fuel valves 12 and 14 and relay R2 are maintained energized over contacts R2A of the relay R2.

Also, when capacitor 41 of the flame sensing network 26 is charged, the potential at point 55 causes the FET device 121 to be "pinched-off" during negative half cycles of the AC signal. Accordingly, during positive half cycles, capacitor 123 charges over the FET device 121 and resistors 122 and 125, and after a time delay established by the charging time of the capacitor 123, prevents further current flow to the gate of the SCR device 118. Thus, the igniter circuit 110 is disabled, and spark generation is terminated as long as a flame impinges on the flame sensing electrode 45.

In response to a loss of flame, the FET device 121 again conducts current in both directions during each AC cycle, thereby enabling the igniter circuit 110 to generate sparks for reigniting the fuel.

The igniter circuit 110 is therefore responsive to the flame and independent of the flame sensing circuit 18 except for deriving its control signal from the flame sensing network 26 which includes only passive components. For a failure of the flame sensing network 26, such as an open or short circuit condition for capacitor 41, the FET device 121 is maintained conducting and thus, the igniter circuit 110 operates to generate sparks continuously.

I claim:

1. In a fuel ignition control system including valve means operable to supply fuel to a burner for ignition to establish a flame, a control arrangement comprising activate means including first switching means operable when enabled to prepare an energizing path for said valve means, and circuit means including energy storage means for causing current to flow over a circuit path including said first switching means and first normally closed contacts, for enabling said first switching means, and flame sensing means including second switching means operable to open said first contacts and to close second contacts to complete said energizing path to energize said valve means, said activate means further including resistance means connected in parallel with said first contacts to provide a holding path for said first switching means when said second switching means operates to open said first contacts.

2. A system as set forth in claim 1 wherein said energy storage means comprises a capacitor connected in a series charging path between a source of an AC energizing signal, to permit said capacitor to be charged during a first half cycle of the AC signal and to discharge over said circuit path during a second half cycle of the AC signal for energizing said first switching means.

3. A system as set forth in claim 1 wherein said activate means further includes timeout means connected in said circuit path and energized in response to current flow thereover to define a trial for ignition interval, and operable to effect the deenergization of at least said valve means in the event that a flame fails to be established within said trial for ignition interval.

4. A system as set forth in claim 1 wherein said valve means includes a pilot valve energized by said first switching means to supply fuel to a pilot outlet for ignition by sparks provided by an igniter means to establish a pilot flame, and a main valve energized by said second switching means to supply fuel to a main burner for ignition by the pilot flame.

5. In a fuel ignition control system including a pilot valve operable to supply fuel to a pilot outlet for ignition to establish a pilot flame, and a main valve operable to supply fuel to a main burner for ignition by the pilot flame, a control arrangement comprising: activate switch means operable to effect the energization of said pilot valve; first switching means operable when enabled to complete a first circuit path; circuit means including energy storage means responsive to said activate switch means for causing current to flow over a second circuit path including said first switching means for enabling said first switching means; flame sensing means including second switching means operable when a flame is sensed to interrupt said second circuit path and to connect said main valve to said first circuit path for energization; and holding circuit means connected in circuit with said first switching means to enable said first switching means to be maintained operated when said second switching means operates to interrupt said second circuit path, said first switching means being prevented from operating over said holding circuit means when said second circuit path is interrupted at the time said activate switch means operates.

6. A system as set forth in claim 5 wherein said second switching means has normally closed contacts connected in said second circuit path, said second switching means being operable to open said contacts when a flame is sensed, and wherein said holding circuit means comprises resistance means connected in shunt with said first switching means, whereby after said first switching means is operated over said second circuit path, said first switching means is maintained operated when said second switching means operates.

7. A system as set forth in claim 5 wherein said pilot valve has an operate solenoid winding connected in said first circuit path for energization thereover in response to operation of said first switching means, said operate winding being maintained deenergized, preventing operation of said pilot valve should said first switching means fail to operate in response to operation of said activate means.

8. In a fuel ignition control system including a pilot valve operable to supply fuel to a pilot outlet for ignition to establish a pilot flame, and a main valve operable to supply fuel to a main burner for ignition by the pilot flame, a control arrangement comprising: activate means including first switching means operable when enabled to complete a first circuit path for energizing said pilot valve, circuit means including energy storage means responsive to said activate means for causing current to flow over a second circuit path including said first switching means for enabling said first switching means, and flame sensing means including second switching means operable when a flame is sensed to interrupt said second circuit path and to connect said main valve to said first circuit path to energize said main valve, said activate means further including resistance means connected in circuit with said first switching means to enable said first switching means to be maintained operated when said second switching means operates to interrupt said second path said first switching means being prevented from operating when said first circuit path is interrupted at the time said activate means operates.

9. A system as set forth in claim 8 wherein said activate means includes timeout means for defining a trial for ignition interval and for effecting deenergization of at least said pilot valve when a flame fails to be sensed before the end of said trial for ignition interval.

10. A system as set forth in claim 9 wherein said timeout means is connected in circuit with said first switching means and is energized by current at a first level which flows through said first circuit path during said trial for ignition interval, said timeout means being maintained energized by current at a second, lower level which flows through a circuit path including said resistance means following operation of said second switching means, said timeout means being operable in response to current flow at said first level for the duration of said trial for ignition interval to interrupt an energizing path for said pilot valve.

11. A system as set forth in claim 9 wherein said timeout means comprises heat responsive switch means having normally closed contacts connected in circuit with an operate solenoid winding for said pilot valve, said switch means being operated to open its contacts to interrupt the supply of power to said pilot valve solenoid winding if a pilot flame fails to be sensed before the end of said trial for ignition interval.

12. A system set forth in claim 9 wherein said timeout means comprises a warp switch having a heating element connected in circuit with said first switching means to be energized by current at an operating level flowing through said first circuit path during said trial for ignition, said heating element being effective to cause associated switch contacts to open and deenergize said pilot valve whenever said heating element remains energized at said operating level for the duration of said trial for ignition interval, and said heating element being prevented from heating sufficiently to operate to interrupt said first circuit path before the end of said trial for ignition interval.

* * * * *